US005308152A

United States Patent [19]

Ho

[11] Patent Number: 5,308,152

[45] Date of Patent: May 3, 1994

[54] WHEEL UNIT FOR IN-LINE ROLLER SKATE

[76] Inventor: Diana Ho, c/o Hung Hsing Patent Service Center, P.O. Box 55-1670, Taipei (10477), Taiwan

[21] Appl. No.: 85,833

[22] Filed: Jul. 6, 1993

[51] Int. Cl.[5] ..... B60B 5/02

[52] U.S. Cl. ..... 301/5.3; 152/323; 280/11.23

[58] Field of Search ..... 301/5.3, 5.7, 64.7; 152/323, 393, 394; 280/11.22, 11.23

[56] References Cited

U.S. PATENT DOCUMENTS

| | | | |
|---|---|---|---|
| 4,045,046 | 8/1977 | Taylor et al. | 301/5.7 X |
| 4,218,098 | 8/1980 | Burton | 301/5.7 |
| 4,944,563 | 7/1990 | Pinchbeck et al. | 152/323 X |
| 5,048,848 | 9/1991 | Olson et al. | 280/11.22 |

FOREIGN PATENT DOCUMENTS

| | | | |
|---|---|---|---|
| 1275899 | 8/1968 | Fed. Rep. of Germany | 301/64.7 |
| 505804 | 12/1954 | Italy | 152/323 |

*Primary Examiner*—Russell D. Stormer

[57] ABSTRACT

A wheel adapted for use on a roller skate or the like includes a wheel member made of elastomer having shock-absorbing property, and a pair of disk members embedded into a central hole of the wheel member, and combinable with each other for firmly clamping two central rim portions on two opposite sides of the wheel member, so that the wheel member secured with the two disk members will be stably rotatably mounted on an axle provided on a mounting frame of a roller skate, a skate board or any other wheeled sporting equipments for enhancing a better stability, heat resistance, shock-absorbing property and ground-treading property of the wheel.

2 Claims, 5 Drawing Sheets

WHEEL UNIT FOR IN-LINE ROLLER SKATE

BACKGROUND OF THE INVENTION

A conventional roller or wheel W secured with a hub H is rotatably mounted on an axle A of a roller skate as shown in FIGS. 1 and 2, in which the roller or wheel W may be made of polyurethane (PU) or polyvinyl chloride (PVC) material. However, such a conventional roller has the following drawbacks:

1. Even polyurethane, for instance, may have good elasticity and resistance to abrasion, but is generally considered to be less resistant to high or low temperature. During a high-speed running of a skate roller, a frictional heat may be produced to deteriorate or damage such PU rollers.

2. In order to reinforce the strength and stability of the PU roller, a rigid central hub H with extension E is integrally secured with the ring-shaped wheel W. Since the wheel W may be made of elastomer foam material, a poor foam product such as unhomogeneous porosity or shrunk molding product will cause instability of the wheel when running the roller skate or even cause sport accident or injury to a player.

3. The wheel W is integrated with hub H so that once the wheel W is damaged the whole wheel unit should be deleted to waste resource.

4. The hub H is merely a circular-shaped disk, having no clamping portions for efficiently clamping the wheel W, so that the wheel unit will be vibrated when gliding a roller skate to thereby influence a stable playing of the skate since the hub H is formed as a "flat" disk without having any clamping flanges provided thereon for clamping the wheel W.

5. No tread grooves exist in the wheel surface to easily cause slipping on a ground surface, also lacking of waterrepelling capability.

The present inventor has found the drawbacks of the rollers or wheels of a conventional roller skate and invented the present wheel having better properties.

SUMMARY OF THE INVENTION

The object of the present invention is to provide a wheel adapted for use on a roller skate or the like including a wheel member made of elastomer having shock-absorbing property, and a pair of disk members embedded into a central hole of the wheel member, and combinable with each other for firmly clamping two central rim portions on two opposite sides of the wheel member, so that the wheel member secured with the two disk members will be stably rotatably mounted on an axle provided on a mounting frame of a roller skate, a skate board or any other wheeled sporting equipments for enhancing a better stability, heat resistance and shock-absorbing properties of the wheel, and for preventing any sport injury.

DETAILED DESCRIPTION

Figure 1:
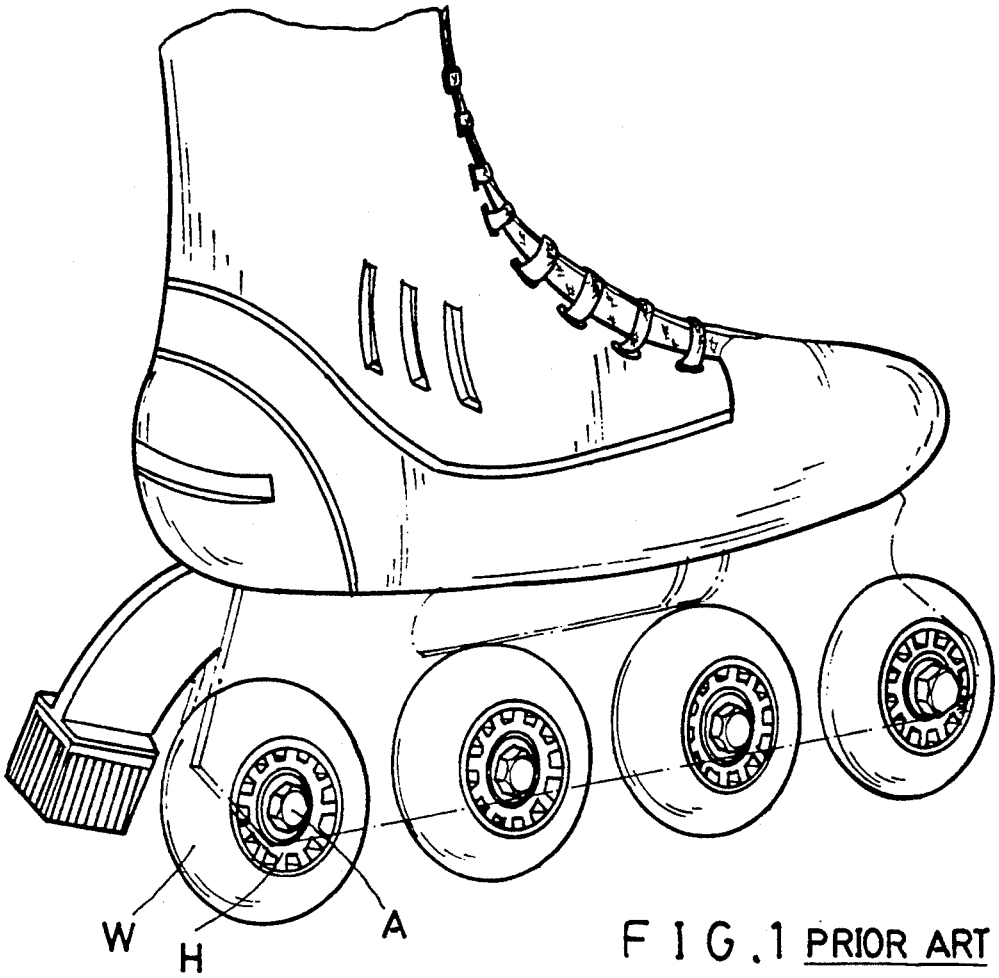
FIG. 1 PRIOR ART
FIG. 1 is a perspective view showing a prior art of conventional wheels of a roller skate.
Figure 2:
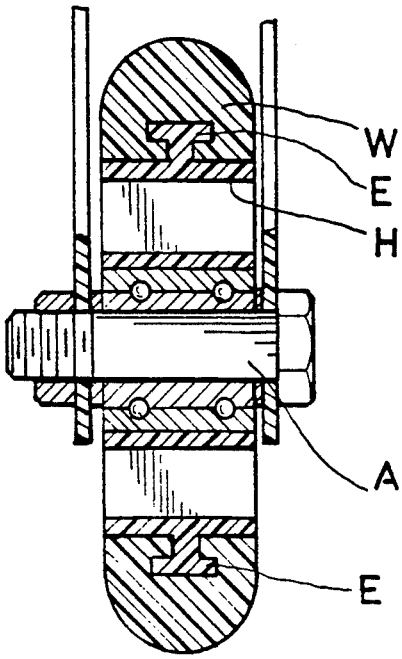
FIG. 2 PRIOR ART
FIG. 2 is a sectional drawing of each wheel as shown in FIG. 1.

As shown in FIGS. 3-6, each wheel unit 100 of the present invention comprises: a wheel member 1, a first disk 2 and second disk 3 disposed on two opposite sides of the wheel member 1 and the two disks 2, 3 combined with each other by a plurality of fixing screws 4, and a pair of bearings 5 each bearing 5 mounted on a bush 6 jacketed on an axle 7 for rotatably mounting the wheel member 1 embedded with the two disks 2, 3 on the axle 7 by means of the bearings 5, with the axle 7 secured to a mounting frame 8 of a boot 9 or a base plate of a roller skate or any other wheeled sporting apparatuses.

The wheel member 1 is formed as a ring or collar shape and may be made of elastomer materials having good properties, such as: shock-absorbing property, heat resistance, maneuverability and stability. A rubber elastomer, a foam elastomer, a rubber or plastic composite material reinforced with ingredients therein for improving the above-mentioned properties of a roller-skate wheel may be used in this invention. The materials and compositions used in this invention are not limited. A porosity of a foam elastomer of the present invention may range between 5%-30%, preferably 10%, but not limited in this invention.

The wheel member 1 embedded with the first and second disk 2, 3 therein includes: a central hole 11 formed through the wheel member 1, a pair of side holes 12 each side hole 12 enlarged from and radially diverged outwardly from the central hole 11 with the pair of side holes 12 disposed on two opposite sides of the central hole 11 of the wheel member 1, and a tread surface 14 formed on a periphery of the wheel member and having a plurality of tread grooves recessed in the tread surface for repelling water and for anti-slipping purpose of the wheel unit 100 when gliding on a ground surface as well as for increasing a ground-treading (or contacting) property especially on corrugated road surfaces.

Figure 4:
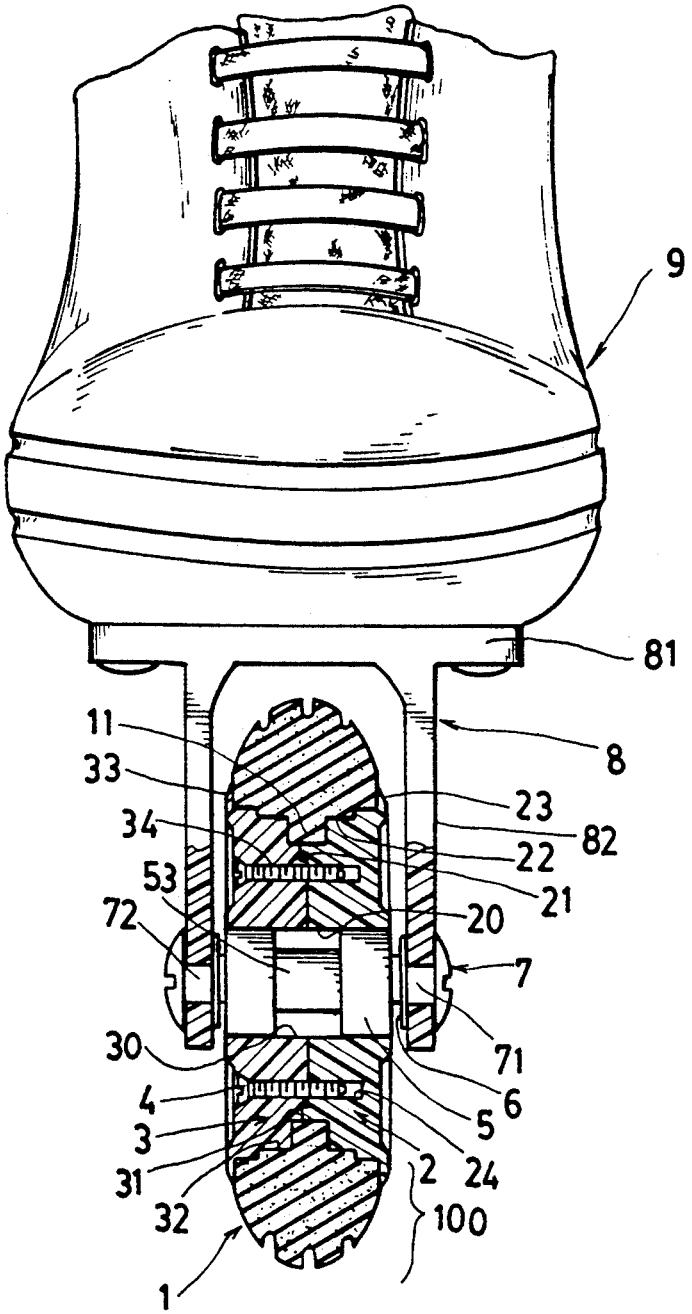
FIG. 4 is a front-view sectional drawing of the present invention.
Figure 5:
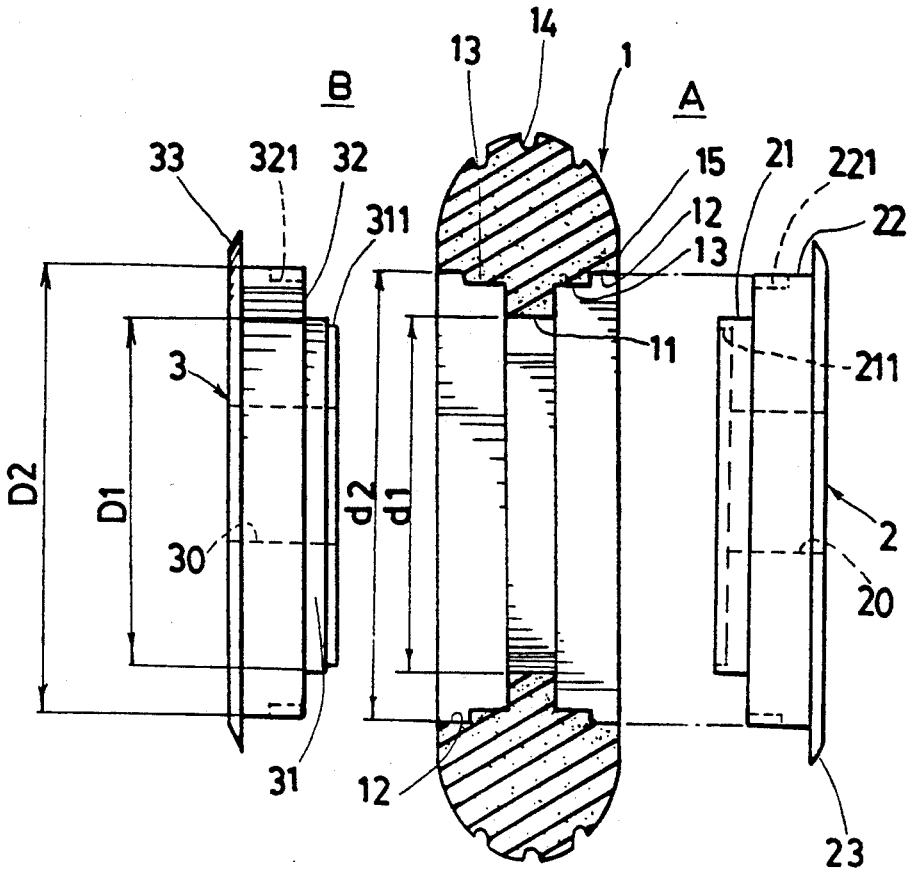
FIG. 5 is a sectional drawing of the present invention during its assembly.
Figure 6:
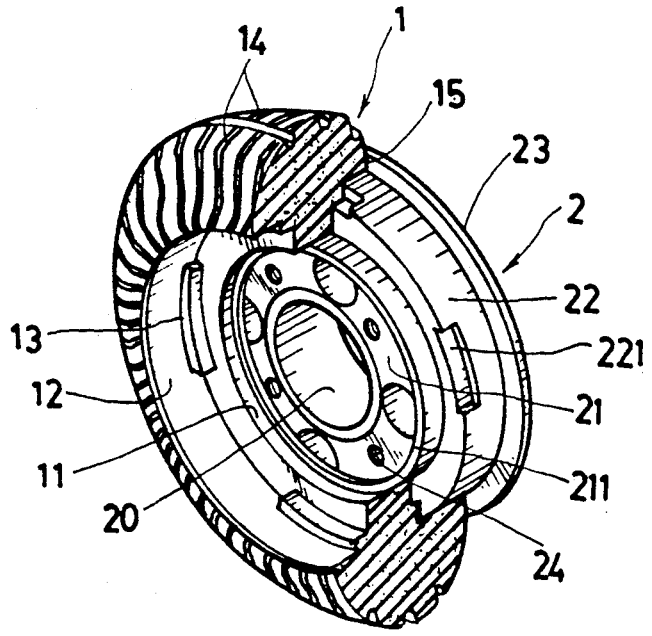
FIG. 6 is a partial cut-away illustration of the present invention.

The first disk 2 as shown in FIGS. 4, 5 and 6 includes: a first disk hole 20 formed through the first disk 2 engageable with a bearing 5 rotatably mounted on an axle 7 of a mounting frame 8 of a boot or a base plate of a roller skate, a skate board or the like, a first coupling portion 21 protruding inwardly from a first intermediate extension 22 of the first disk 2 to be engageable with a first half portion of the central hole 11 of the wheel member 1, and a first clamping flange 23 formed on an outer portion of the first disk 2 connected with the first intermediate extension 22 of the first disk 2 for operatively retaining a first central rim portion 15 disposed on a first side surface of the wheel member 1 in cooperation with the second disk 3 with the first intermediate extension 22 engageable with the side hole 2 disposed on a first side portion A of the wheel member 1.

The second disk 3 as shown in FIGS. 5, 4 includes: a second disk hole 30 formed through the second disk 3 aligned with the first disk hole 20 and engageable with a bearing 5 rotatably mounted on the axle 7 of the mounting frame 8 of a roller skate 9 or the like, a second coupling portion 31 protruding inwardly from a second intermediate extension 32 of the second disk 3 towards the first coupling portion 21 of the first disk 2 when embedded in the wheel member 1 to be engageable with a second half portion of the central hole 11 of the wheel member 1, and a second clamping flange 33 formed on an outer portion of the second disk 3 connected with the second intermediate extension 32 of the second disk 3 for operatively retaining a second central rim portion 15 disposed on a second side surface B of the wheel member 1 in cooperation with the first disk 2, with the second intermediate extension 32 engageable with the other side hole 12 disposed on a second side portion B of the wheel member 1, and with the second disk 3 combinable with the first disk 2 into the central hole 11 and the two side holes 12 in the wheel member 1 by a plurality of fixing screws 4 inserted through a plurality of screw holes 34, 24 respectively formed in the second disk 3 and in the first disk 2.

The second disk 3 has a rim groove 311 annularly recessed in a periphery of the second coupling portion 31 of the second disk 3 to be engageable with a rim extension 211 annularly protruding inwardly from the first disk 2 towards the second disk 3 when mounted in the wheel member 1 to allow both coupling portions 31, 21 of the two disks 3, 2 to be engageable with the central hole 11 of the wheel member 1.

Either second disk 3 or first disk 2 is formed with a plurality of protrusion recesses 321 or 221 annularly recessed in each intermediate extension 32 or 22 of each disk 3 or 2 to be engageable with a plurality of protrusions 13 concentrically formed on a perimeter of each side hole 12 of the wheel member 1 so that each disk 3 or 2 will be firmly engaged with the wheel member 1 to prevent any unexpected decoupling or disengagement of either disk 3 or 2 from the wheel member 1.

As shown in FIG. 5, an outside diameter D1 of each coupling portion 31 or 21 of either disk 3 or 2 should be slightly larger than an inside diameter d1 of the central hole 11 of the wheel member 1 ($D1>d1$); and an outside diameter D2 of each intermediate extension 32 or 22 of either disk 3 or 2 should be slightly larger than an inside diameter d2 of each side hole 12 of the wheel member 1 ($D2>d2$) for a firm and stable embedding of the two disks into the central and side holes 11, 12 in the wheel member 1, and after fixing the screws 4 into screw holes 34, 24 formed in the two disks 3, 2, the two disks 3, 2 will be firmly combined to clamp the wheel member 1 in between the two disks 3, 2 for enhancing a stability of the wheel unit 100 used in a roller skate, and also for preventing a collapse or reciprocative rightward and leftward vibrations of the wheel member 1 made of elastomers, thereby enhancing its shock-absorbing property to be helpful for running a roller skate under safer condition.

Therefore, the present invention may enhance the many properties of a roller skate provided with the wheel unit 100 of this invention, namely, a better shock-absorbing property, enhanced stability, smooth maneuverability, and even an improved heat resistance if the elastomer material is selected from a rubber composite, or other temperature durable polymers.

Figure 3:
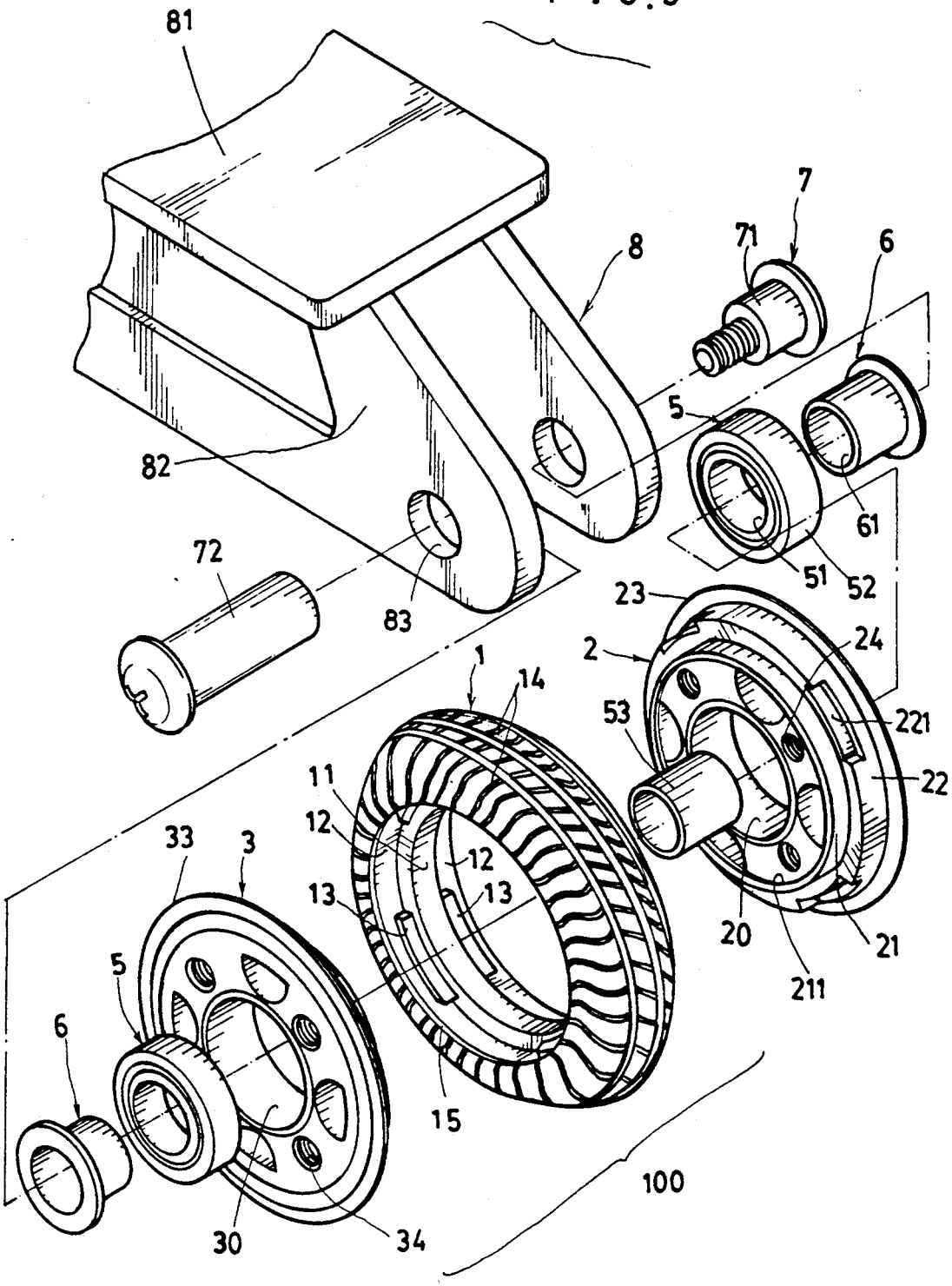
FIG. 3 is an exploded view of a wheel unit in accordance with the present invention.

As shown in FIGS. 3, 4, each bearing 5 includes an inner ring 51 rotatably engageable with a bush 6 having a bush hole 61 engageable with the axle 7 comprised of a male shaft 71 secured in an axle hole 83 formed in a bracket 82 disposed on a first side portion of a mounting frame 8 and a female sleeve 72 coupled with the male shaft 71 and secured in the other axle hole 83 formed in the other bracket 82 disposed on a second side portion of the mounting frame 8 with a sole plate 81 of the mounting frame 8 secured to a boot 9 of a roller skate or the like, and an outer ring 52 engageable with the either disk hole 20 or 30.

Figure 7:
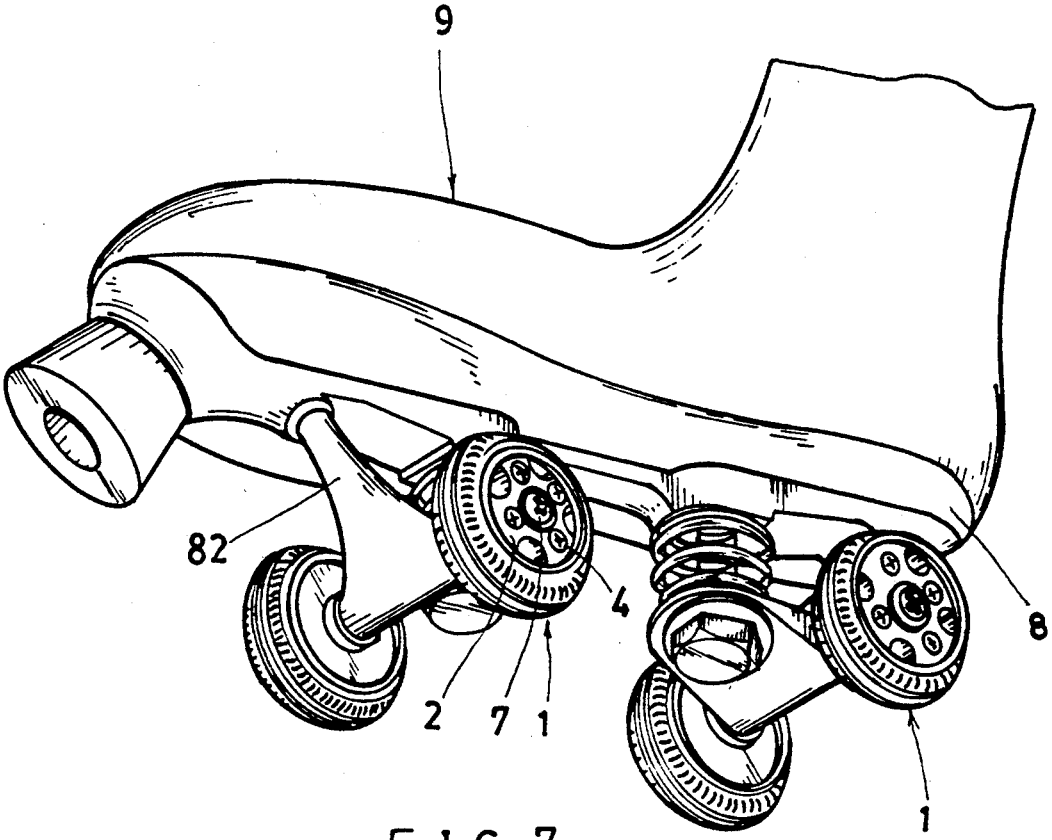
FIG. 7 is a perspective view of another preferred embodiment of the present invention.
Figure 8:
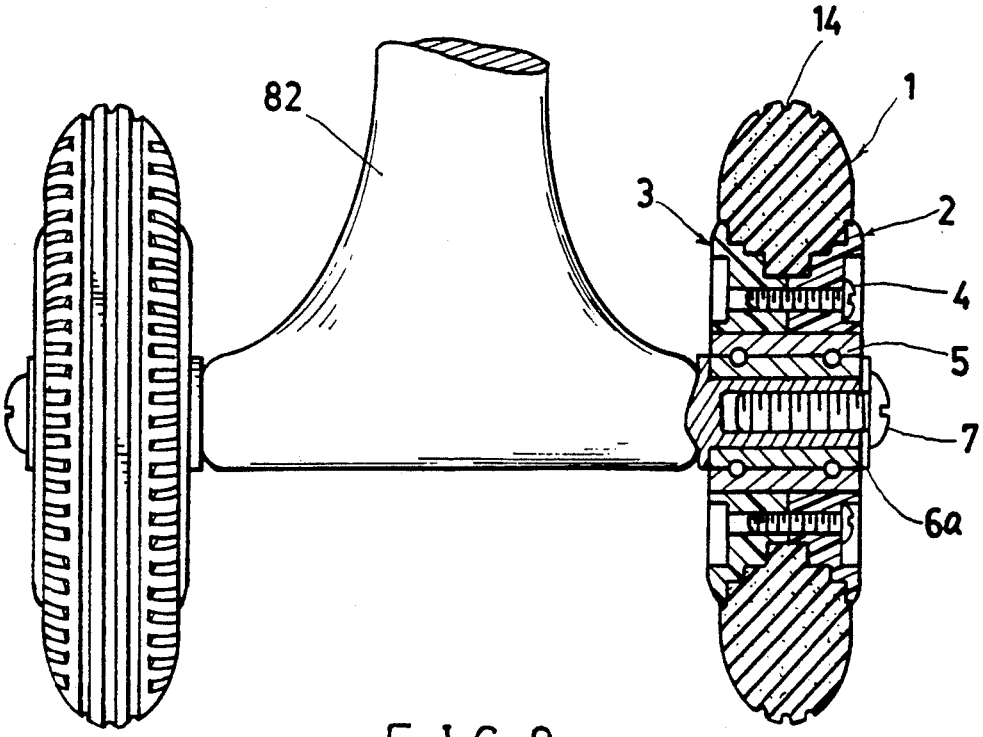
FIG. 8 is a partial sectional drawing of the wheel as taken from a pair of wheels of the skate as shown in FIG. 7.

A bearing spacer 53 is disposed in between the two bearings 5 as shown in FIG. 4. However, the two bearings 5 may also be modified as a single bearing such as shown in FIGS. 7, 8, when used in a four-wheel roller skate. The bush 6 may also be simplified to be a washer or retainer 6*a* for limiting the bearing 5 on the axle 7.

The uses of the wheel unit 100 of the present invention is not limited. It may be used in an aligned or in-line rollers or plural rollers of a roller skate. Besides, a skate board, or other sporting apparatuses provided with small wheels or rollers may also use the wheel units of the present invention to improve their physical properties, helpful for smoothly running the wheels of the sporting equipments.

The present invention may be modified without departing from the spirit and scope of this invention.

Even though the wheel member 1 of this invention is damaged, a maintenance job can be simply done by merely replacing the damaged wheel member 1, without replacing all other relevant parts, such as disks 2, 3, to prevent wasting of resources. This is also an advantage of the present invention in addition to those improved physical properties as aforementioned.

I claim:

1. A wheel unit adapted for use on an in-line roller skate comprising:

a wheel member made of elastomer material having a central hole formed through said wheel member;

a first disk and a second disk combinable with each other and engageable with the central hole in said wheel member, with said first and second disks cooperatively firmly clamping said wheel member in between two said disks, said wheel member embedded with and clamped by said two disks being rotatably mounted on an axle of a mounting frame positioned under an in-line roller skate;

said wheel member including: the central hole formed through the wheel member, a pair of side holes each said side hole enlarged from and radially diverged outwardly from the central hole with the pair of side holes disposed on two opposite sides of the central hole of the wheel member;

said first disk including: a first disk hole formed through the first disk engageable with a first bearing rotatably mounted on an axle of a mounting frame of a roller skate, a first coupling portion protruding inwardly from a first intermediate extension of the first disk to be engageable with a first half portion of the central hole of the wheel member, and a first clamping flange formed on an outer portion of the first disk connected with the first intermediate extension of the first disk for operatively retaining a first central rim portion disposed on a first side surface of the wheel member in cooperation with the second disk, with the first intermediate extension engageable with the side hole disposed on a first side portion of the wheel member; said second disk including: a second disk hole formed through the second disk aligned with the first disk hole and engageable with a second bearing rotatably mounted on the axle of the mounting frame of the roller skate, a second coupling portion protruding inwardly from a second intermediate extension of the second disk towards the first coupling portion of the first disk when embedded in the wheel member to be engageable with a second half portion of the central hole of the wheel member, and a second clamping flange formed on an outer portion of the second disk connected with the second intermediate extension of the second disk for operatively retaining a second central rim portion disposed on a second side surface of the wheel member in cooperation with the first disk, with the second intermediate extension engageable with the other side hole disposed on a second side portion of the wheel member, and with the second disk combinable with the first disk into the central hole and the two side holes in the wheel member by a plurality of fixing screws inserted through a plurality of screw holes respectively formed in the second disk and in the first disk;

said second disk having a rim groove annularly recessed in a periphery of the second coupling portion of the second disk to be engageable with a rim extension annularly protruding inwardly from the first disk towards the second disk when mounted in the wheel member to allow both said coupling portions of the two disks to be engageable with the central hole of the wheel member; each said disk formed with a plurality of protrusion recesses annularly recessed in each said intermediate extension of each said disk to be engageable with a plurality of protrusions concentrically formed on a perimeter of each said side hole of the wheel member so that each said disk is firmly engaged with the wheel member to prevent any unexpected disengagement of each said disk from the wheel member; and each said coupling portion of each said disk having an outside diameter slightly larger than an inside diameter of the central hole of the wheel member; and each said intermediate extension of each said disk having an outside diameter slightly larger than an inside diameter of each said side hole of the wheel member for a firm and stable embedding of said two disks into the central hole and the side holes in the wheel member, whereby upon a fixing of the screws into screw holes formed in said two disks, the two disks will be firmly combined to clamp the wheel member in between the two disks for enhancing a stability of the wheel unit used in the roller skate.

2. A wheel unit according to claim 1, wherein each said bearing includes an inner ring rotatably engageable with a bush having a bush hole engageable with the axle comprised of a male shaft secured in an axle hole formed in a bracket disposed on a first side portion of the mounting frame and a female sleeve coupled with the male shaft and secured in the other axle hole formed in the other bracket disposed on a second side portion of the mounting frame with a sole plate of the mounting frame secured to a boot of a roller skate, and an outer ring engageable with a disk hole of each said disk.

* * * * *